US006428426B1

(12) United States Patent
Helmstetter et al.

(10) Patent No.: US 6,428,426 B1
(45) Date of Patent: Aug. 6, 2002

(54) GOLF CLUB STRIKING PLATE WITH VARIABLE BULGE AND ROLL

(75) Inventors: Richard C. Helmstetter, Rancho Santa Fe; Roger C. Cleveland, Los Angeles; D. Clayton Evans, San Marcos; Garth W. Smith, Vista, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 36 days.

(21) Appl. No.: 09/606,659

(22) Filed: Jun. 28, 2000

(51) Int. Cl.[7] ..... A63B 53/04

(52) U.S. Cl. ..... 473/330; 473/345; 473/329; 473/342; 473/331

(58) Field of Search ..... 473/290, 291, 473/292, 324, 329, 342, 345, 346, 330, 331, 349, 350, 347, 348

(56) References Cited

U.S. PATENT DOCUMENTS

| | | | | |
|---|---|---|---|---|
| 2,023,885 | A | * | 12/1935 | Hinckley |
| 2,395,837 | A | * | 3/1946 | Baymiller |
| 3,625,518 | A | | 12/1971 | Solheim |
| 4,367,878 | A | | 1/1983 | Schmidt |
| 4,521,022 | A | * | 6/1985 | Schmidt |
| 4,725,062 | A | | 2/1988 | Kinney, III |
| 5,141,231 | A | | 8/1992 | Cox |
| 5,310,185 | A | * | 5/1994 | Viollaz |
| 5,415,405 | A | | 5/1995 | Vincent |
| 5,681,228 | A | | 10/1997 | Mikame et al. |
| 5,830,084 | A | * | 11/1998 | Kosmatka |
| 5,839,975 | A | * | 11/1998 | Lundberg |
| 5,971,868 | A | * | 10/1999 | Kosmatka |
| 6,007,432 | A | * | 12/1999 | Kosmatka |
| 6,093,115 | A | * | 7/2000 | Murtland |
| 6,139,445 | A | * | 10/2000 | Werner |
| 6,179,727 | B1 | * | 1/2001 | Giordano |
| 6,183,380 | B1 | * | 2/2001 | Yim |

FOREIGN PATENT DOCUMENTS

| | | |
|---|---|---|
| EP | 0 786 271 A2 | 7/1997 |
| EP | 0 800 846 A2 | 10/1997 |
| EP | 1 005 882 A1 | 6/2000 |
| GB | 2 258 408 A | 2/1993 |
| JP | 05177018 | 7/1993 |

* cited by examiner

*Primary Examiner*—Sebastiano Passaniti
(74) *Attorney, Agent, or Firm*—Michael A. Catania

(57) ABSTRACT

A golf club head having a striking plate with variable roll radius of curvature and a variable bulge radius of curvature is disclosed herein. The striking plate preferably has a large surface area which requires correction of off-center shots. The striking plate may be used on a fairway wood-type golf club head or a driver-type golf club head. The striking plate is preferably composed of steel or titanium.

25 Claims, 8 Drawing Sheets

GOLF CLUB STRIKING PLATE WITH VARIABLE BULGE AND ROLL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club striking plate. More specifically, the present invention relates to a golf ball striking plate having a variable bulge and roll.

2. Description of the Related Art In order to reduce hooking and slicing of a golf ball, golf club manufacturers have constructed clubs that have faces with convex curvatures of radius along a horizontal plane (the bulge) and convex curvatures of radius along a vertical plane (the roll). The bulge radius reduces the tendency to hook and slice while the roll radius lowers the spin to increase the distance lost to the bulge radius. Typically, the face has had only one bulge radius of curvature and a single roll radius of curvature.

Presently, high performance, large volume golf club heads (in excess of 300 cubic centimeters in volume) having deeper or more circular faces have been introduced by golf club manufacturers. The high performance, large volume golf club heads generally provide greater distance off the tee for a typical golfer. However, the large surface area of the faces has led to more off-center shots that hook or slice further than previous golf clubs. Thus, current high performance, large volume golf club heads provide for greater distance but are less forgiving than previous golf club heads such as the BIGGEST BIG BERTHA® from the Callaway Golf Company of Carlsbad, Calif.

Many persimmon woods "rounded off" the upper toe quadrant and lower heel quadrant of the face of the golf club head in order to improve the appearance of the golf club head. This rounding off effected the bulge radius of curvature and roll radius of curvature in such areas of the face. An example of such is the CALLAWAY® CLASSIC SERIES, which was sold in the eighties by the Callaway Golf Company.

Vincent, U.S. Pat. No. 5,415,405, filed originally in France in 1992, for a Hitting Surface Of A Golf Club Head, discloses a face that has at least three bulge radii of curvature along an imaginary line with adjacent bulge radii having unequal radii.

Japanese Laid-Open Patent Application Number 05177018, filed in 1991 for a Golf Club Head, discloses a protruded curved surface of the face that has a larger curvature than the curvature at the center of the face.

Kinney, III, U.S. Pat. No. 4,725,062, filed in 1986, for a Wood-Type Golf Club Head, discloses a golf club head with a rounded face having a single vertical roll and a single horizontal bulge.

European Patent Application Number 1005882, originally filed in the U.S. in 1998 as Ser. No. 203563, discloses a golf club head with a face that has at least two bulge radii of curvature.

Schmidt, U.S. Pat. No. 4,367,878, filed in 1981, for a Golf Club Head, discloses a golf club head with a parabolic face.

Solheim, U.S. Pat. No. 3,625,518, for a Golf Club Head With Complex Curvature For The Sole And/Or The Striking Face, filed in 1969, discloses a wood golf club head that has a complex bulge curvature and complex roll curvature in relation to an elliptical sweet spot area of the striking face.

Mikame et al., U.S. Pat. No. 5,681,228, for a Golf Club Head, filed in 1995, discloses a golf club head that has a single bulge curvature and a single roll curvature that are both in relation to a gravity depth of the golf club head.

Gebauer et al., U.S. Pat. No. 4,508,349, for a Golf Club, filed in 1983, discloses a golf club head that has a bulge radius of curvature that increases toward the heel of the club head and decreases toward the toe of the club head.

Although the prior art has disclosed golf club head with faces that have variable bulge and roll curvatures, the prior art has failed to address specific variation of the bulge and roll curvatures for large size, high volume golf club heads.

BRIEF SUMMARY OF THE INVENTION

The present invention is directed at a striking plate for a high performance, large volume golf club head that has a variable roll radius of curvature and a variable bulge radius of curvature to correct off-center shots. Further, the striking plate has regions of varying thickness that allow for more compliance during impact with a golf ball.

One aspect of the present invention is a golf club head having a body having a crown, a sole, a heel end, a toe end and a striking plate. The striking plate has a first roll radius along a vertical mid-area and a second roll radius along an upper toe quadrant or a lower heel quadrant. The striking plate may also have a roll radius of curvature in the other of the upper toe quadrant or the lower heel quadrant.

Another aspect of the present invention is a golf club head including a body having a crown, a sole, a heel end and a toe end, and a striking plate. The striking plate has a first bulge radius along a vertical mid-area and a second bulge radius along an upper toe quadrant or a lower heel quadrant. The striking plate may also have a third bulge radius along the other of the upper toe quadrant or the lower heel quadrant of the striking plate.

Yet another aspect of the present invention is a striking plate for a golf club head. The striking plate includes a first roll radius along a vertical mid-area of the striking plate, a second roll radius along an upper toe quadrant of the striking plate, a third roll radius along a lower heel quadrant of the striking plate, a first bulge radius along a horizontal mid-area of the striking plate, a second bulge radius along an upper toe quadrant of the striking plate, and a third bulge radius along a lower heel quadrant of the striking plate.

The primary object of the present invention is to provide a striking plate for a golf club head that has a variable bulge radius of curvature and/or a variable roll radius of curvature.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
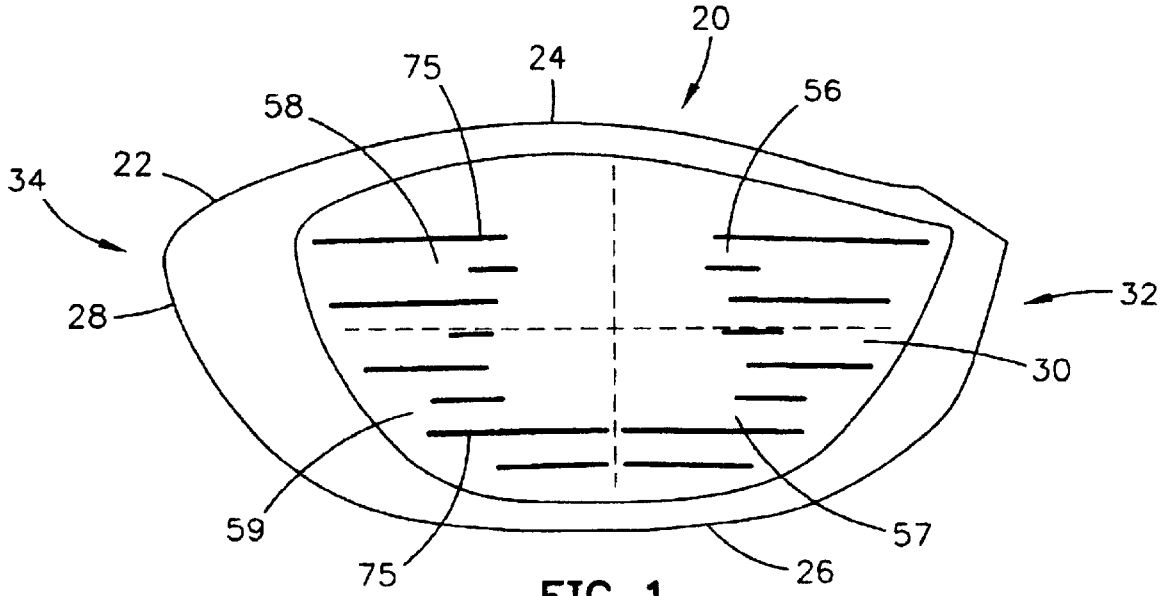
FIG. 1 is a front plan view of a golf club head with the striking plate of the present invention.

As shown in FIGS. 1–8, a golf club head is generally designated 20. The golf club head 20 has a body 22 with a crown 24, a sole 26, a ribbon 28 and a striking plate 30. The striking plate 30 generally extends from a heel end 32 to a toe end 34 of the front of the golf club head 20. The striking plate 30 has a unique variable bulge and a variable roll. The variable bulge and the variable roll will be explained in greater detail below. The body 22 preferably has an internal hosel 36 for receiving the tip end of a shaft, not shown, through an aperture 38. The golf club head has a body 22 that is preferably composed of a metal material such as titanium, titanium alloy, stainless steel, or the like, and is most preferably composed of a forged titanium material. The body 22 preferably has a large volume, most preferably greater than 300 cubic centimeters, and is most preferably 350 cubic centimeters. The body 22 preferably weighs no more than 215 grams, and most preferably weighs between 180 and 205 grams. The body 22 has a hollow interior 23.

The striking plate 30 is partitioned into a plurality of regions 40, 42, 44 and 46, defined by lines 41, 43, 45 and 47, each having a different thickness or different thickness range. The exterior surface 53 of the striking plate is substantially smooth for impact with a golf ball, while the interior surface 55 of the striking plate varies in thickness creating a non-planar surface that is contoured according to impact probabilities as described in further detail below. The striking plate is unitary in construction, and may or may not be composed of the same material of the body 22. The term unitary when used in conjunction with the striking plate 30 means that the striking plate is a single piece and does not have additions to the interior surface 55 such as ribs or weighting members. A central region 40, defined by dashed line 41, and has a base thickness that is preferably the greatest thickness of the regions 40, 42, 44 and 46. The base thickness ranges from 0.260 inch to 0.060 inch, preferably from 0.150 inch to 0.075 inch, and is most preferably within the range of 0.145 inch to 0.090 inch. A transition region 42 has a thickness that ranges between the thickness of the central region 40 and a first peripheral region 44, preferably ranges from 0.150 inch to 0.090 inch, and most preferably ranges from 0.140 inch to 0.080 inch. The first peripheral region 44 has a thickness that ranges from 0.110 inch to 0.040 inch, preferably ranges from 0.105 inch to 0.050 inch, and most preferably ranges from 0.100 inch to 0.075 inch. A second peripheral region 46 preferably is the thinnest region of the striking plate regions 40, 42, 44 and 46. The second peripheral region 46 has a thickness that ranges from 0.085 inch to 0.010 inch, preferably ranges from 0.080 inch to 0.045 inch, and most preferably ranges from 0.075 inch to 0.050 inch.

Figure 1A:
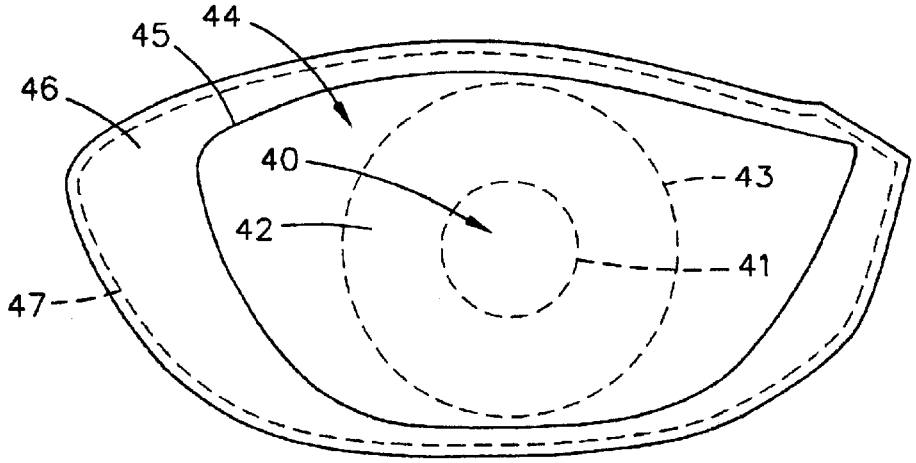
FIG. 1A is a front plan view of the golf club head of FIG. 1 with the variable face thickness pattern superimposed thereon and the scorelines removed.

In a preferred embodiment, as shown in FIG. 1A, the central region has a thickness range of 0.145 inch to 0.090 inch, the transition region 42 has a thickness range of 0.140 inch to 0.080 inch, the first peripheral region 44 has a thickness range of 0.105 inch to 0.050 inch, and the second peripheral region 46 has a thickness range of 0.075 inch to 0.050 inch.

Preferably, as shown in FIG. 1A, the central region 40 is 5% to 15% of the surface area of the core face 49 of the striking plate 30. The core face 49 is defined as the central region 40, the transition region 42 and the first peripheral region 44. The core face area of the striking plate 30 has an area between 4.80 square inches and 5.50 square inches, preferably between 5.10 square inches and 5.40 square inches, and most preferably 5.38 square inches. The transition region 42 is preferably 35% to 50% of the surface area of the core face 49, and the first peripheral region 44 is preferably 40% to 55% of the surface area of the core face 49. In a preferred embodiment, the central region is 8.8% of the surface area of the core face 49, the transition region is 42.2% of the surface area of the core face 49, and the first peripheral region 44 is 50% of the surface area of the core face 49.

FIGS. 6–8A illustrate the variable bulge and roll of the striking plate of the present invention. To better described the variable bulge and variable roll, the striking plate 30 may be partitioned into four quadrants, an upper heel quadrant 56, a lower heel quadrant 57, an upper toe quadrant 58 and a lower toe quadrant 59. The striking plate 30 has a first roll radius of curvature 60 that generally lies along a vertical mid-section of the striking plate 30. The striking plate has a second roll radius of curvature 61 that lies in the upper toe quadrant 58. The radius of curvature of the first roll radius of curvature 60 is different than the second roll radius of curvature 61. The striking plate has a third roll radius of curvature 62 that lies in the lower heel quadrant 57. The radius of curvature of the first roll radius of curvature 60 is different than the third roll radius of curvature 62. In a preferred embodiment, the radius of curvature of the second roll radius of curvature 61 and the third roll radius of curvature 62 are different, however, alternative embodiments may have them the same.

The striking plate 30 also has a first bulge radius of curvature 63 that generally lies along a horizontal mid-section of the striking plate 30. The striking plate 30 has a second bulge radius of curvature 64 that lies in the upper toe quadrant 58. The radius of curvature of the first bulge radius of curvature 63 is different than the second bulge radius of curvature 64. The striking plate 30 has a third bulge radius of curvature 65 that lies in the lower heel quadrant 57. The radius of curvature of the first bulge radius of curvature 63 is different than the third bulge radius of curvature 65. In a preferred embodiment, the radius of curvature of the second bulge radius of curvature 64 and the third bulge radius of curvature 65 are different, however, alternative embodiments may have them the same.

Figure 6:
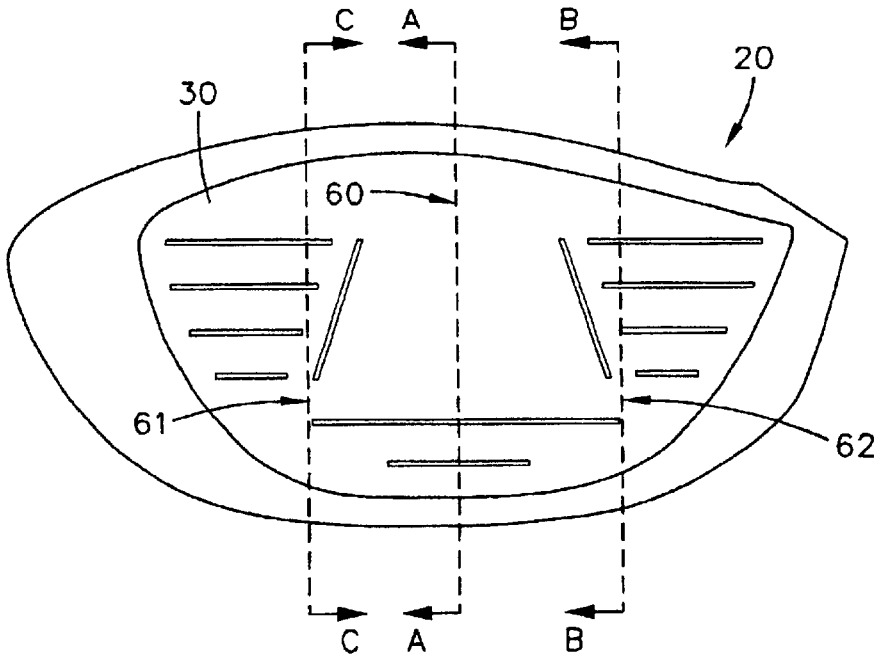
FIG. 6 is a front plan view of a golf club head with the striking plate of the present invention.
Figure 6A:
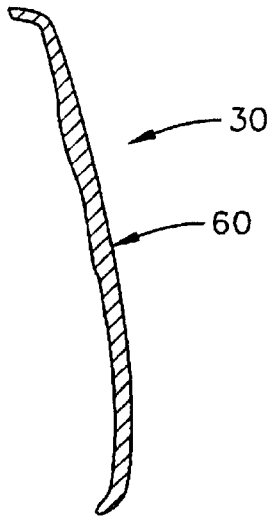
FIG. 6A is a cross-sectional view along line A—A of FIG. 6.
Figure 6B:
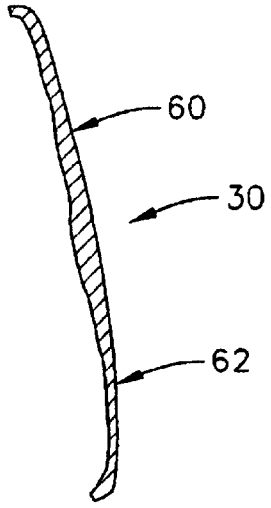
FIG. 6B is a cross-sectional view along line B—B of FIG. 6.
Figure 6C:
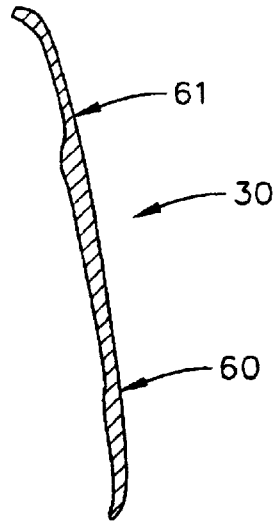
FIG. 6C is a cross-sectional view along line C—C of FIG. 6.

As shown in FIG. 6B, the third roll radius of curvature 62 lies along a portion of the lower heel quadrant 57 while continuing upward along the vertical, the radius of curvature will transition into the first roll radius of curvature 60. As shown in FIG. 6C, the second roll radius of curvature 61 lies along a portion of the upper toe quadrant 58 while continuing downward along the vertical, the radius of curvature will transition into the first roll radius of curvature 60.

Figure 7:
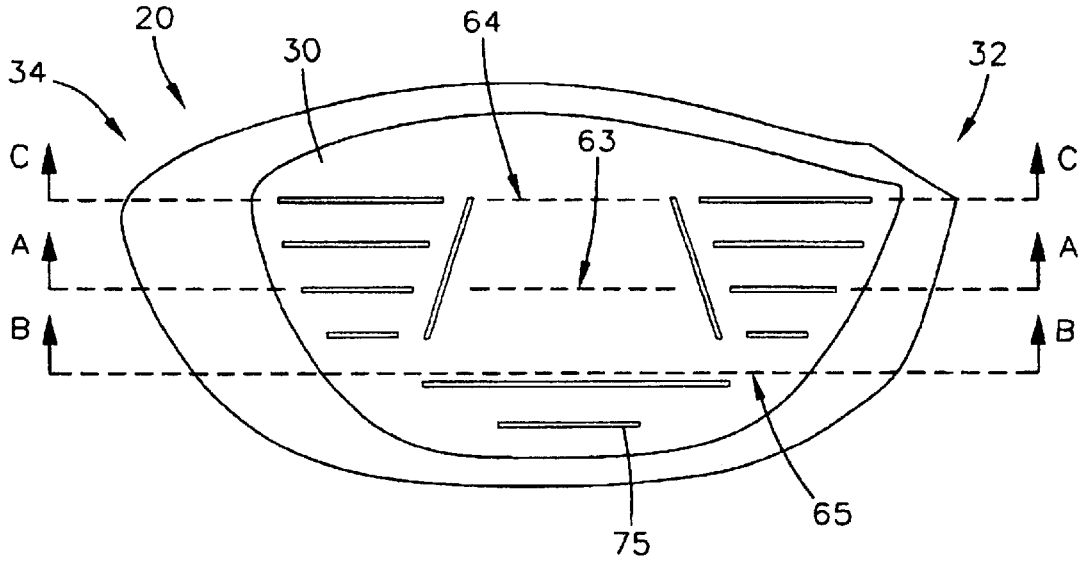
FIG. 7 is a front plan view of a golf club head with the striking plate of the present invention.
Figure 7A:
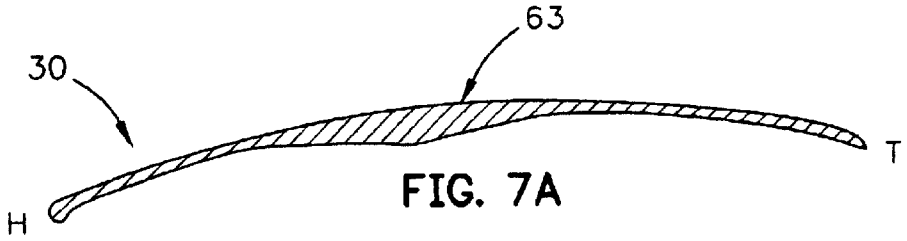
FIG. 7A is a cross-sectional view along line A—A of FIG. 7.
Figure 7B:
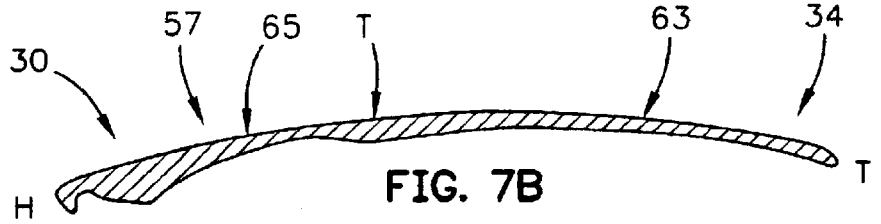
FIG. 7B is a cross-sectional view along line B—B of FIG. 7.
Figure 7C:
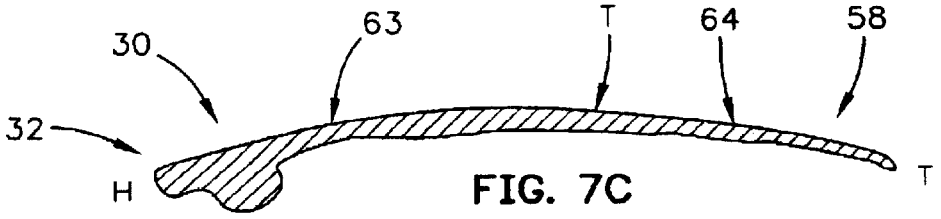
FIG. 7C is a cross-sectional view along line C—C of FIG. 7.
Figure 8:
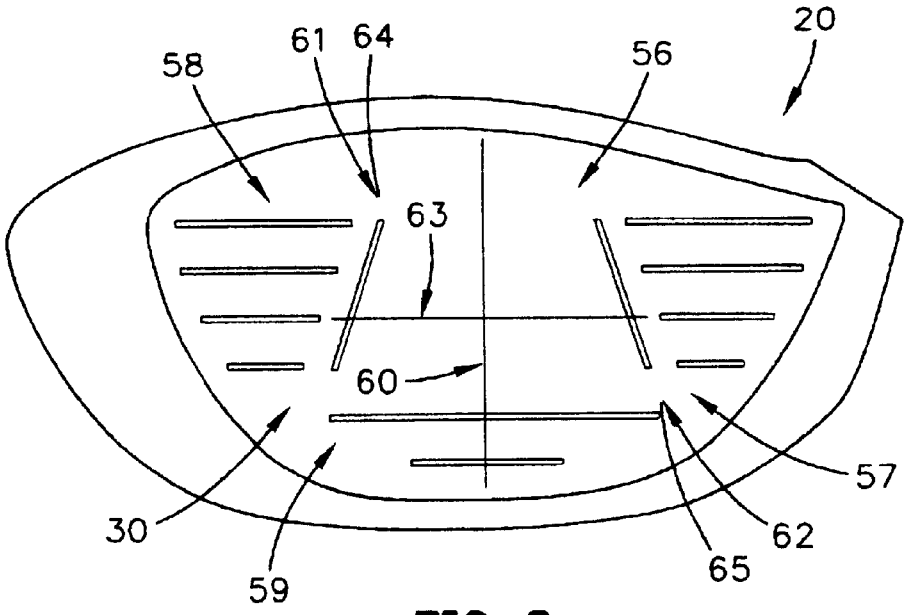
FIG. 8 is a front plan view of a golf club head with the striking plate of the present invention.
Figure 8A:
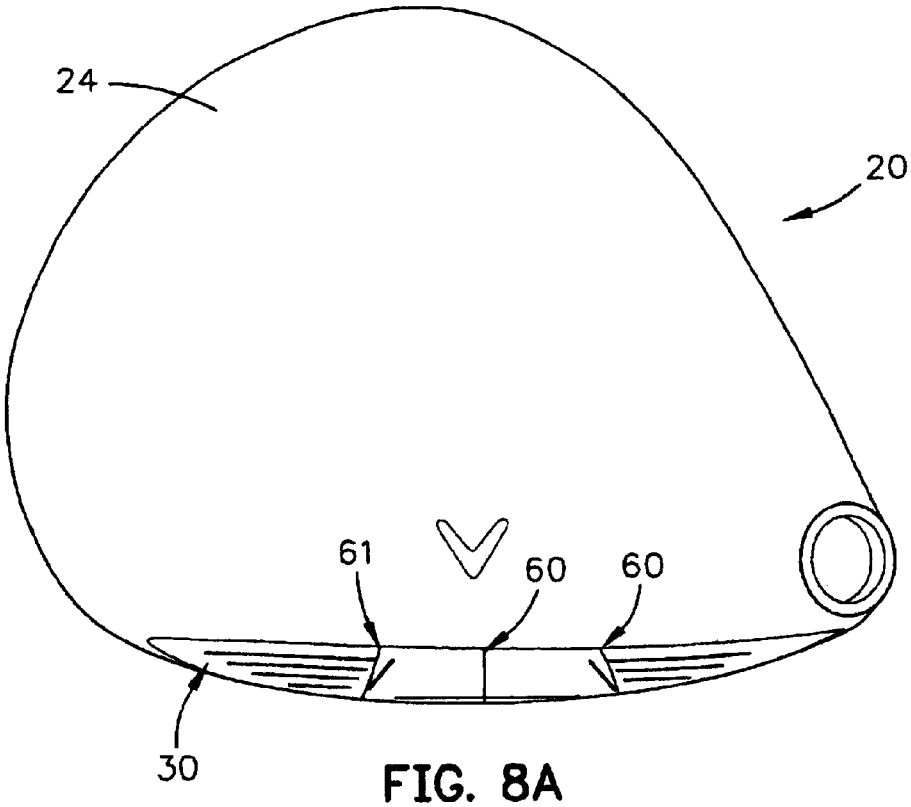
FIG. 8A is a top plan view of the golf club head of FIG. 8.

As shown in FIG. 7A, the horizontal mid-point of the striking plate 30 has a constant first bulge radius of curvature 63 from heel to toe. As shown in FIG. 7B, the third bulge radius of curvature 65 lies along a portion of the lower heel quadrant 57 while continuing toward the toe end 34 along the horizontal, the radius of curvature will transition into the first bulge radius of curvature 63. As shown in FIG. 7C, the second bulge radius of curvature 64 lies along a portion of the upper toe quadrant 58 while continuing toward the heel end 32 along the horizontal, the radius of curvature will transition into the first bulge radius of curvature 60.

In an alternative embodiment, at point T, the first bulge radius of curvature 63 will transition into multiple radii of curvatures in the lower heel quadrant 57 and in the upper toe quadrant 58. Thus, instead of a single bulge radius of curvature 64 or 65, there are multiple bulge radii of curvature. The striking plate may also have similar roll radii of curvature.

Preferably, the first roll radius of curvature 60 is approximately 11.00 inches, the second roll radius of curvature 61 is approximately 9.353 inches, and the third roll radius of curvature 62 is approximately 8.071 inches. Preferably, the first bulge radius of curvature 63 is approximately 10.50 inches, the second bulge radius of curvature 64 is approximately 10.15 inches, and the third bulge radius of curvature 65 is approximately 9.963 inches. However, those skilled within the pertinent art will recognize that other radius of curvatures may be utilized without departing from the scope and content of the present invention.

Table One sets forth the thickness ranges of the central region 40, the first peripheral region 44 and the second peripheral region 46 for preferred embodiments for drivers (lofts 7 degrees through 12 degrees) and fairway woods (2 wood through 9 wood).

TABLE ONE

| | Striking Plate Thickness | | |
|---|---|---|---|
| Club | Second Peripheral Region | First Peripheral Region | Center Region |
| 07° Driver | .050 ± .005 | .100 ± .005 | .140 ± .005 |
| 08° Driver | .050 ± .005 | .100 ± .005 | .140 ± .005 |
| 09° Driver | .050 ± .005 | .100 ± .005 | .140 ± .005 |
| 10° Driver | .050 ± .005 | .100 ± .005 | .140 ± .005 |
| 11° Driver | .050 ± .005 | .100 ± .005 | .140 ± .005 |
| 12° Driver | .050 ± .005 | .100 ± .005 | .140 ± .005 |
| 2 Wood | .050 ± .005 | .090 ± .005 | .130 ± .005 |
| 3 Wood | .055 ± .005 | .090 ± .005 | .130 ± .005 |
| Strong 3 | .060 ± .005 | .090 ± .005 | .130 ± .005 |
| 4 Wood | .060 ± .005 | .085 ± .005 | .125 ± .005 |
| Strong 4 | .065 ± .005 | .090 ± .005 | .130 ± .005 |
| 5 Wood | .065 ± .005 | .085 ± .005 | .125 ± .005 |
| 7 Wood | .070 ± .005 | .085 ± .005 | .125 ± .005 |
| 9 Wood | .075 ± .005 | .085 ± .005 | .125 ± .005 |

Figure 1B:
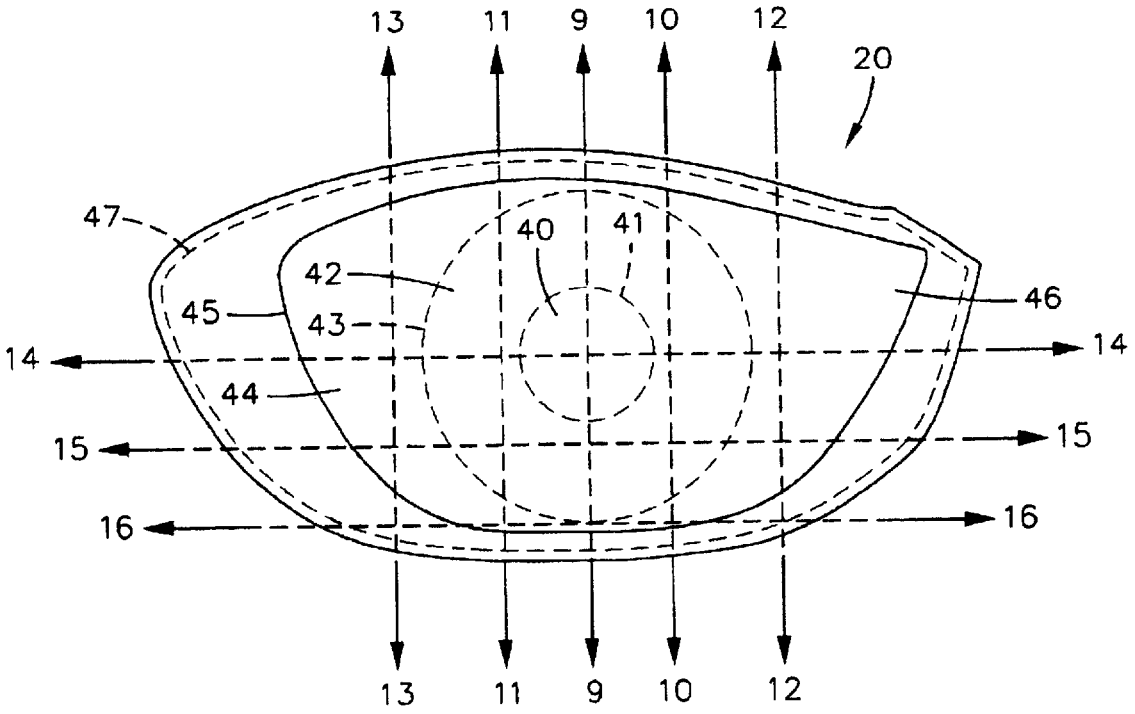
FIG. 1B is a front plan view of the golf club head of FIG. 1 with the variable face thickness pattern superimposed thereon.
Figure 2:
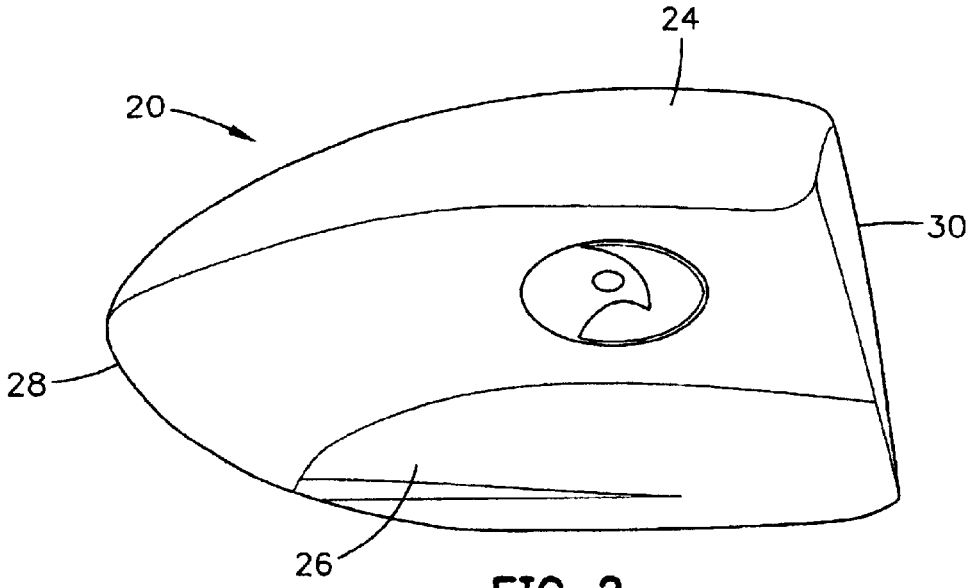
FIG. 2 is a toe side view of the golf club head of FIG. 1.
Figure 3:
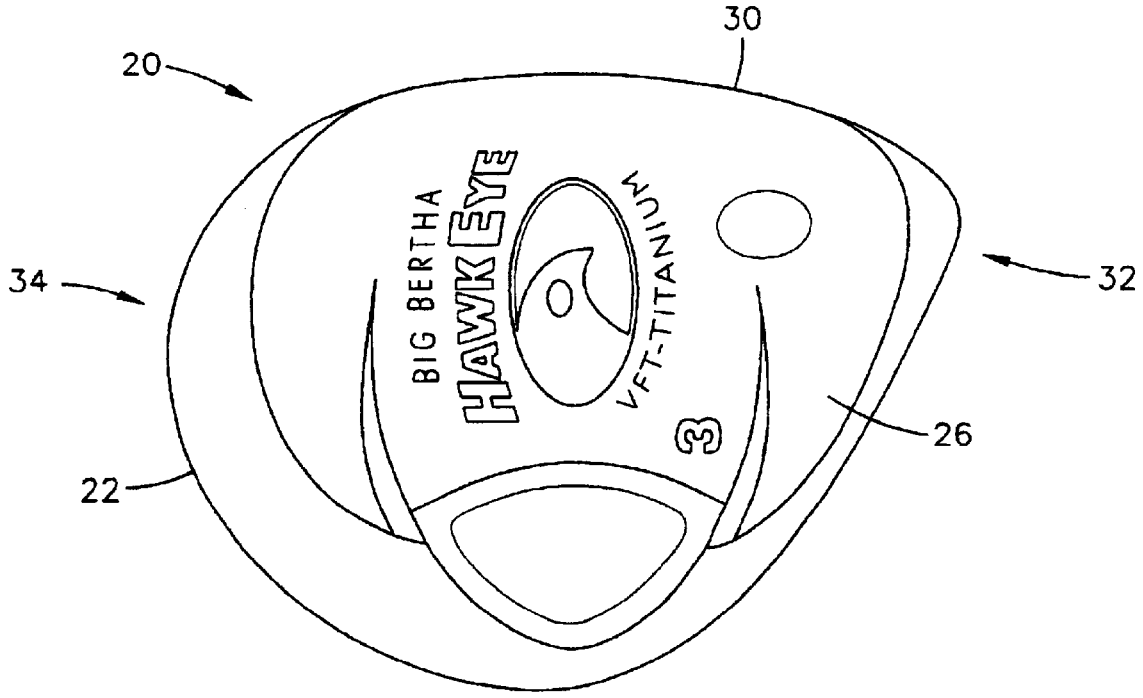
FIG. 3 is a bottom plan view of the golf club head of FIG. 1.
Figure 4:
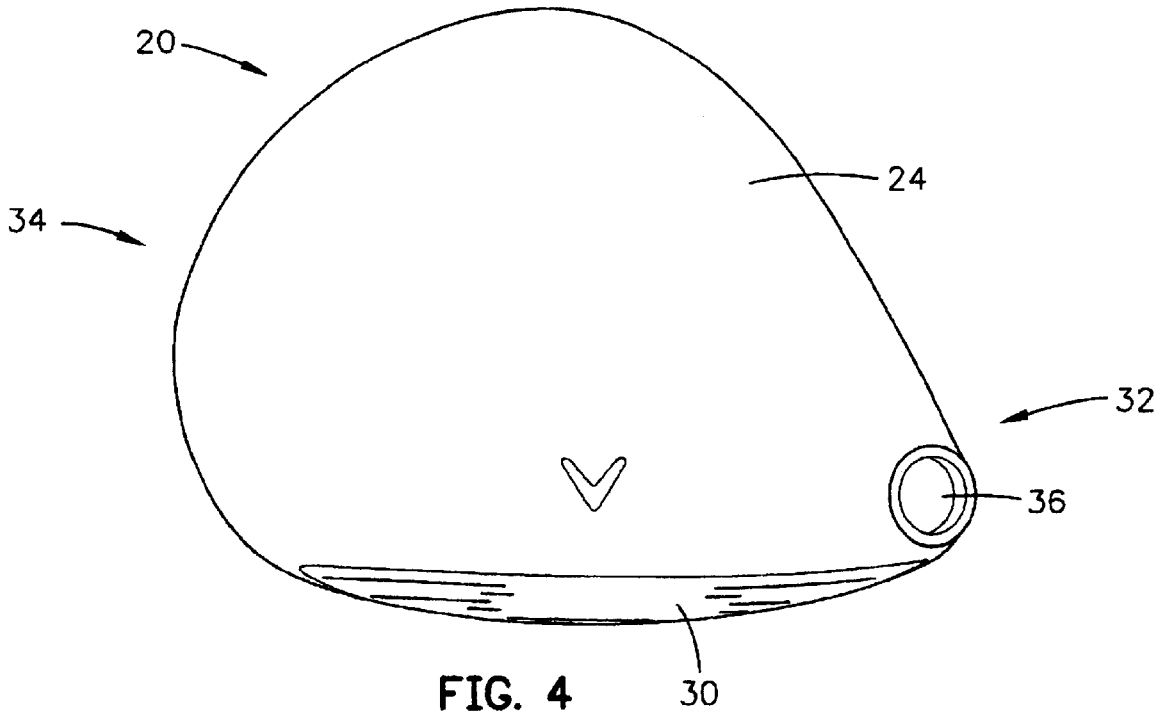
FIG. 4 is a top plan view of the golf club head of FIG. 1.
Figure 5:
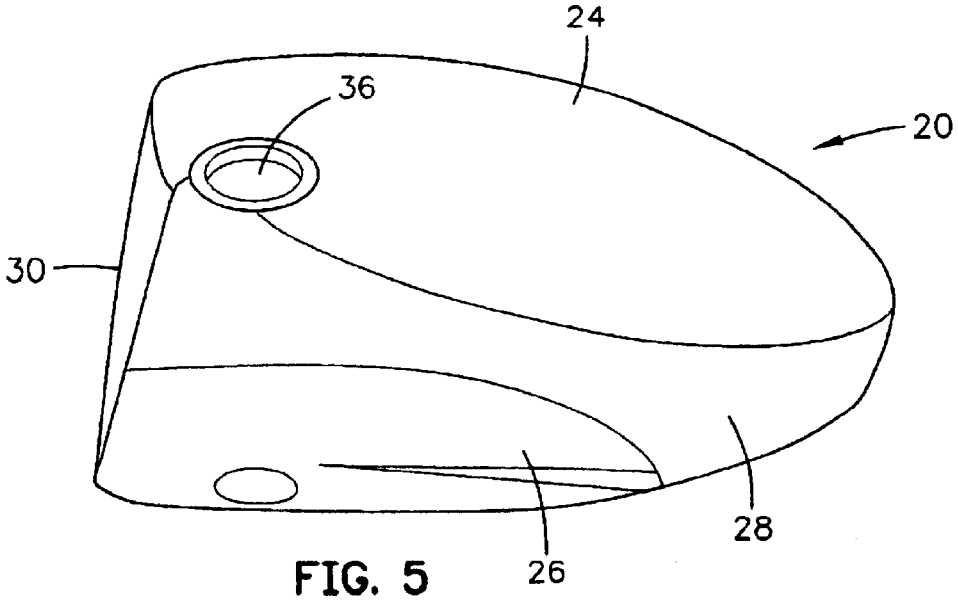
FIG. 5 is a heel side view of the golf club head of FIG. 1.
Figure 9:
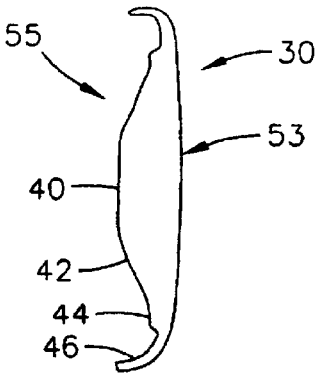
FIG. 9 is a cross-sectional view along lines 9—9 of FIG. 1B.
Figure 10:
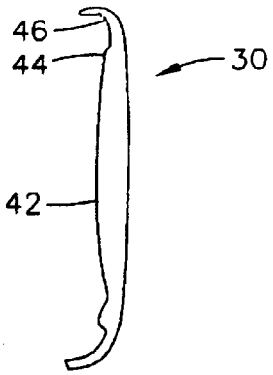
FIG. 10 is a cross-sectional view along lines 10—10 of FIG. 1B.
Figure 11:
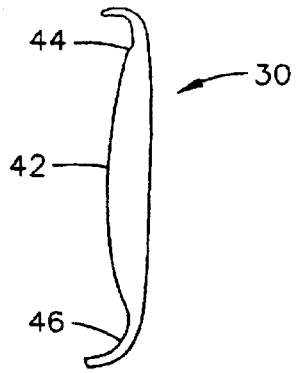
FIG. 11 is a cross-sectional view along lines 11—11 of FIG. 1B.
Figure 12:
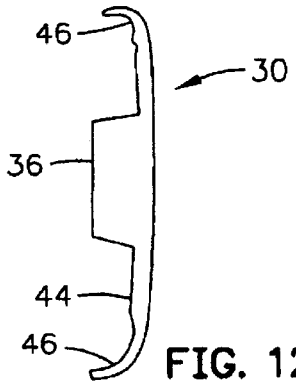
FIG. 12 is a cross-sectional view along lines 12—12 of FIG. 1B.
Figure 13:
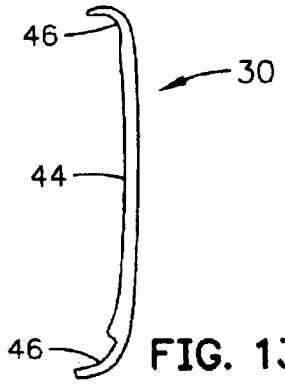
FIG. 13 is a cross-sectional view along lines 13—13 of FIG. 1B.

Cross-sections of the striking plate 30, taken from FIG. 1B, are illustrated in FIGS. 9–16. FIG. 9 illustrates a vertical cross-section of the mid-section of the striking plate 30 with the central region 40, the transition region 42, the first peripheral region 44 and the second peripheral region 46 on the contoured interior surface 55 as opposed to the relatively smooth, albeit scorelines, of the exterior surface 55 of the striking plate 30. FIGS. 10 and 11 illustrate vertical cross-sections that are adjacent both sides of the mid-section, and which only includes the transition region 42, the first peripheral region 44 and the second peripheral region 46. FIG. 12 illustrates a vertical cross-section on the heel end 32 of the striking plate 30 that has a wall of the internal hosel 36 integrated therewith in a preferred embodiment. FIG. 12 otherwise shows the first peripheral region 44 and the second peripheral region 46. Although the wall of the internal hosel 36 is shown as integrated with the striking plate 30, alternative embodiments have the internal hosel off-set from the interior surface 55 of the striking plate 30. FIG. 13 illustrates a vertical cross-section of the toe end 34 of the striking plate 30, which only includes the first peripheral region 44 and the second peripheral region 46.

Figure 14:
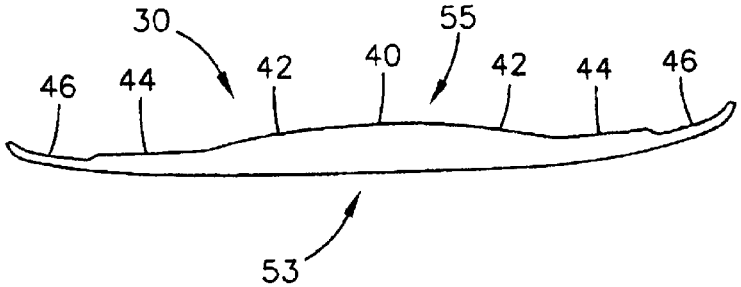
FIG. 14 is a cross-sectional view along lines 14—14 of FIG. 1B.
Figure 15:
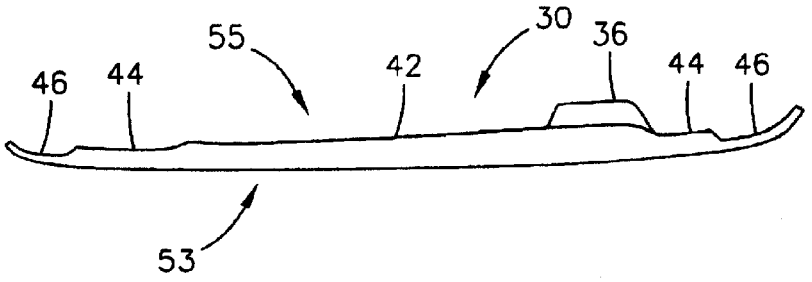
FIG. 15 is a cross-sectional view along lines 15—15 of FIG. 1B.
Figure 16:
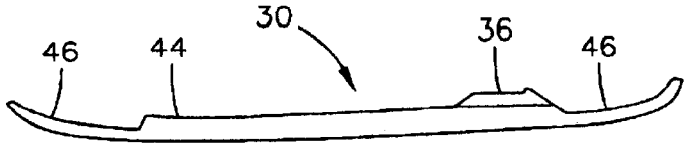
FIG. 16 is a cross-sectional view along lines 16—16 of FIG. 1B.

FIG. 14 illustrates a horizontal cross-section of the horizontal mid-section of the striking plate 30, which shows the central region 40, the transition region 42, the first peripheral region 44, the second peripheral region 46, and the wall of the internal hosel 36. FIG. 15 illustrates a horizontal cross-section below the horizontal mid-section of the striking plate 30, which only includes the transition region 42, the first peripheral region 44, the second peripheral region 46, and the wall of the internal hosel 36. FIG. 16 illustrates a horizontal cross-section further below the horizontal mid-section of the striking plate 30, which only includes the first peripheral region 44, the second peripheral region 46, and the wall of the internal hosel 36.

Although the striking plate has been described with one preferred variable thickness pattern, other variable thickness patterns may be used without departing from the scope and spirit of the present invention. Such variable thickness patterns are described in U.S. Pat. Nos. 5,830,084, 5,971,868 and 6,007,432 which pertinent parts are hereby incorporated by reference.

The striking plate 30 will also have a plurality of scorelines 75 thereon which will effect the thickness of each of the regions 40, 42, 44 and 46 at each particular scoreline. A more detailed explanation of the scorelines 75 is set forth in co-pending U.S. patent application Ser. No. 09/431,518, filed on Nov. 1, 1999, entitled Contoured Scorelines For The Face Of A Golf Club, and incorporated by reference in its entirety.

The variation in the thickness of the striking plate 30 also allows for the greatest thickness of regions 40, 42, 44 and 46 to be distributed in the center region 40 of the striking plate 30 thereby enhancing the flexibility of the striking plate 30 which corresponds to greater compliance of the striking plate 30 during impact with a golf ball thereby providing for reduced energy loss which allows for greater distance. The variable roll radii of curvature of the striking plate 30 and the variable bulge radii of curvature of the striking plate 30 allow for correction of off-center shots. The large surface area of the striking plate 30 necessitates the variable roll radius of curvature of the striking plate 30 and the variable bulge radius of curvature of the striking plate 30 to prevent hooking and slicing while providing greater distance.

The striking plate 30 is preferably composed of a stainless steel. Alternatively, the striking plate 30 is composed of a titanium or titanium-alloy material. In yet an alternative embodiment, the striking plate 30 is composed of a vitreous metal such as iron-boron, nickel-copper, nickel-zirconium, nickel-phosphorous, and the like. Yet in further alternative embodiments, the striking plate 30 is composed of ceramics, composites or other metals.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a body having a crown, a sole, a striking plate, a heel end and a toe end, the body having a hollow interior and a volume greater than 300 cubic centimeters, the striking plate partitioned into an upper toe quadrant, a lower toe quadrant, an upper heel quadrant and a lower heel quadrant, the striking plate having a first roll radius along a vertical mid-area that divides the upper heel quadrant from the upper toe quadrant and divides the lower heel quadrant from the lower toe quadrant, the striking plate having a second roll radius along an upper toe quadrant or a lower heel quadrant, the second roll radius unequal to the first roll radius.

2. The wood-type golf club head according to claim 1 further comprising a third roll radius along the other of the upper toe quadrant or the lower heel quadrant of the striking plate, the third roll radius unequal to either of the first roll radius or the second roll radius.

3. The wood-type golf club according to claim 2 wherein the first roll radius is approximately 11.0 inches, the second roll radius is approximately 9.3 inches, and the third roll radius is approximately 8.1 inches.

4. The wood-type golf club head according to claim 1 wherein the first roll radius is approximately 11.0 inches and the second roll radius is approximately 9.3 inches.

5. The wood-type golf club head according to claim 1 wherein the striking plate further comprises a first bulge radius along a horizontal mid-area and a second bulge radius along the upper toe quadrant or the lower heel quadrant, the horizontal mid-area dividing the upper to quadrant from the lower toe quadrant and dividing the upper heel quadrant from the lower heel quadrant, and the second bulge radius unequal to the first bulge radius.

6. The wood-type golf club head according to claim 5 further comprising a third bulge radius along the other of the upper toe quadrant or the lower heel quadrant of the striking plate, the third bulge radius unequal to the first bulge radius or the second bulge radius.

7. The wood-type golf club head according to claim 5 wherein the first bulge radius is approximately 10.50 inches and the second bulge radius is approximately 10.15 inches.

8. The wood-type golf club according to claim 6 wherein the first bulge radius is approximately 10.50 inches, the second bulge radius is approximately 10.15 inches, and the third bulge radius is approximately 9.96 inches.

9. The wood-type golf club head according to claim 1 wherein the striking plate further comprises a central region, a transition region and a first peripheral region, the central region having a first thickness and occupying 5% to 15% of the exterior surface of a core face area, the transition region encompassing the central region and occupying 35 to 50% of the exterior surface of a core face area, the first peripheral region encompassing the transition region and occupying 40% to 55% of the exterior surface of the core face, the first peripheral region having a thickness less than the first thickness, the transition region having a thickness that transition from the first thickness to the second thickness.

10. The wood-type golf club head according to claim 9 wherein the central region has a thickness in the range of 0.120 inch to 0.145 inch.

11. The wood-type golf club head according to claim 9 wherein the central region occupies approximately 8.8% of the core face area, the transition region occupies 42.2% of the core face area and the first peripheral region occupies 50% of the core face area.

12. The wood-type golf club head according to claim 9 wherein the first peripheral region has a thickness range of 0.110 inch to 0.075 inch.

13. The wood-type golf club head according to claim 9 further comprising a second peripheral region encompassing the first peripheral region and having a thickness range of 0.045 inch to 0.080 inch.

14. The golf club head according to claim 1 wherein the striking plate is composed of a material selected from the group consisting of titanium, titanium alloys, steels and vitreous metals.

15. The wood-type golf club head according to claim 1 wherein a core face area of the striking plate has an area between 4.80 square inches and 5.20 square inches.

16. A wood-type golf club head comprising:

a body composed of a titanium alloy and having a volume greater than 300 cubic centimeters, the body having a crown, a sole and a striking plate, the striking plate partitioned into an upper toe quadrant, a lower toe quadrant, an upper heel quadrant and a lower heel quadrant, the striking plate having a first bulge radius along a horizontal mid-area that divides the upper toe quadrant from the lower toe quadrant and divides the upper heel quadrant from the lower heel quadrant, the striking plate having a first roll radius along a vertical mid-area that divides the upper toe quadrant from the upper heel quadrant and divides the lower toe quadrant from the lower heel quadrant, the striking plate having a second bulge radius along the upper toe quadrant and a third bulge radius along the lower heel quadrant wherein the first bulge radius, the second bulge radius and the third bulge radius are all unequal, the striking plate having a second roll radius along the upper toe quadrant and a third roll radius along the lower heel quadrant, wherein the first roll radius, the second roll radius and the third roll radius are all unequal.

17. The wood-type golf club head according to claim 16 wherein the first bulge radius is approximately 10.50 inches and the second bulge radius is approximately 10.15 inches.

18. The wood-type golf club according to claim 16 wherein the first bulge radius is approximately 10.50 inches, the second bulge radius is approximately 10.15 inches, and the third bulge radius is approximately 9.96 inches.

19. The wood-type golf club head according to claim 16 wherein the striking plate further comprises a central region and a first peripheral region, the central region having a first thickness and occupying 5% to 15% of the exterior surface of a core face area, the transition region encompassing the central region and occupying 35 to 50% of the exterior surface of a core face area, the first peripheral region encompassing the transition region and occupying 40% to 55% of the exterior surface of the core face, the first peripheral region having a thickness less than the first thickness, the transition region having a thickness that transition from the first thickness to the second thickness.

20. The wood-type golf club head according to claim 19 wherein the central region has a thickness in the range of 0.120 inch to 0.145 inch.

21. The wood-type golf club head according to claim 19 wherein the first peripheral region has a thickness range of 0.110 inch to 0.075 inch.

22. The wood-type golf club head according to claim 16 wherein a core face area of the striking plate has an area between 4.80 square inches and 5.20 square inches.

23. A wood-type golf club head comprising:

a body composed of a titanium alloy and having a volume greater than 300 cubic centimeters, the body having a crown, a sole and a striking plate, the striking plate partitioned into an upper toe quadrant, a lower toe quadrant, an upper heel quadrant and a lower heel quadrant, the striking plate having a core face area of the striking plate has an area between 4.80 square inches and 5.20 square inches, the striking plate having a first roll radius along a vertical mid-area of the striking plate;

a second roll radius along an upper toe quadrant of the striking plate;

a third roll radius along a lower heel quadrant of the striking plate;

a first bulge radius along a horizontal mid-area of the striking plate;

a second bulge radius along an upper toe quadrant of the striking plate; and a third bulge radius along a lower heel quadrant of the striking plate.

24. The wood-type golf club head according to claim 23 wherein the first, second and third roll radii are only along a portion of the vertical mid-section, upper toe quadrant and lower heel quadrant respectively, and the first, second and third bulge radii are only along a portion of the horizontal mid-section, upper toe quadrant and lower heel quadrant respectively.

25. The wood-type golf club head according to claim 23 wherein the first roll radius is approximately 11.0 inches, the second roll radius is approximately 9.3 inches, and the third roll radius is approximately 8.1 inches, the first bulge radius is approximately 10.50 inches, the second bulge radius is approximately 10.15 inches, and the third bulge radius is approximately 9.96 inches.

* * * * *